US006010617A

United States Patent [19]

Mackerer et al.

[11] Patent Number: 6,010,617

[45] Date of Patent: Jan. 4, 2000

[54] PROCESS FOR PRODUCING NON-CARCINOGENIC COAL-TAR-DERIVED PRODUCTS

[75] Inventors: Carl R. Mackerer, Pennington; Timothy A. Roy, Hopewell, both of N.J.; Gary R. Blackburn, Washington Crossing, Pa.

[73] Assignee: Mobil Oil Corporation, Fairrfax, Va.

[21] Appl. No.: 08/255,542

[22] Filed: Jun. 6, 1994

Related U.S. Application Data

[63] Continuation of application No. 07/976,030, Nov. 13, 1992, abandoned.

[51] Int. Cl.[7] ..... C10G 1/20; C10G 35/04; C07C 2/66

[52] U.S. Cl. ..... 208/44; 208/135; 585/446; 585/459; 585/467; 585/468

[58] Field of Search ..... 208/2, 14, 22, 208/44, 135; 585/446, 459, 467, 468

[56] References Cited

U.S. PATENT DOCUMENTS

| | | | |
|---|---|---|---|
| Re. 28,341 | 2/1975 | Wadlinger et al. | 208/120 |
| 2,833,834 | 5/1958 | Rehner, Jr. et al. | 208/2 |
| 2,904,607 | 9/1959 | Mattox et al. | 208/135 |
| 2,987,560 | 6/1961 | Holmes et al. | 585/419 |
| 3,109,038 | 10/1963 | Myers | 585/467 |
| 3,251,897 | 5/1966 | Wise | 585/467 |
| 3,308,069 | 3/1967 | Wadlinger et al. | 252/455 |
| 4,097,368 | 6/1978 | Hayes | 208/139 |
| 4,157,950 | 6/1979 | Frilette et al. | 208/135 |
| 4,321,094 | 3/1982 | Batt et al. | 106/32 |
| 4,409,094 | 10/1983 | Longwell et al. | 208/121 |
| 4,429,176 | 1/1984 | Chester et al. | 585/481 |
| 4,469,913 | 9/1984 | Dessau | 208/310 Z |
| 4,499,187 | 2/1985 | Blackburn et al. | 435/34 |
| 4,519,841 | 5/1985 | Moynihan | 106/27 |
| 4,522,929 | 6/1985 | Chester et al. | 502/77 |
| 4,524,230 | 6/1985 | Haensel | 208/138 |
| 4,594,146 | 6/1986 | Chester et al. | 208/111 |
| 4,663,492 | 5/1987 | Chester et al. | 585/408 |
| 4,954,325 | 9/1990 | Rubin et al. | 423/328 |
| 5,034,119 | 7/1991 | Blackburn et al. | 208/309 |

OTHER PUBLICATIONS

Speight, James, "The Chemistry and Technology of Petroleum", 1991, pp. 529–532 and 545–549.

(IARC) Evaluation of the Carcinogenic Risk of Chemicals to Humans vol. 35 pp. 83–110 Jan. 1985.

Carcinogenesis, vol. 10, Huberman & Barr, Raven Press, New York, 1985, pp. 449–463.

Acc. Chem. Res., 21, Harvey & Geacintov, 1988, pp. 66–73.

J. Org. Chem., 47, Pataki et al., 1982, pp. 1133–1136.

*Primary Examiner*—Walter D. Griffin

*Attorney, Agent, or Firm*—Malcolm D. Keen

[57] ABSTRACT

A process for reducing the mutagenicity of a coal-tar-based product containing polynuclear aromatic compounds. The process includes the step of contacting the coal-tar-based product in the presence of an alkylating agent with an acid catalyst under alkylation conditions sufficient to reduce the mutagenicity of the polynuclear aromatic containing coal-tar-based material to a level less than the initial mutagenicity index value. Also provided are non-carcinogenic coal-tar-derived products.

9 Claims, No Drawings

PROCESS FOR PRODUCING NON-CARCINOGENIC COAL-TAR-DERIVED PRODUCTS

This is a continuation of Application Ser. No. 07/976,030, filed Nov. 13, 1992, now abandoned.

FIELD OF THE INVENTION

The present invention relates to useful coal-tar-based products, and to a process for their preparation. More particularly, this invention is directed to coal-tar-based products of reduced mutagenicity, and to a process for reducing the polynuclear aromatic mutagenicity of such products.

BACKGROUND OF THE INVENTION

Coal-tar is a by-product produced during the destructive distillation of coal, known as carbonization or coking. The composition and properties of a coal-tar depend mainly on the temperature of the carbonization and, to a lesser extent, on the nature of the coal used as the feedstock. Coal-tars are usually black viscous liquids or semi-solids, with a characteristic, naphthalene-like odor. Compositionally, coal-tars are complex combinations of hydrocarbons, phenols and heterocyclic oxygen, sulphur and nitrogen compounds. Over 400 compounds have been identified in coal-tars, and it has been estimated that probably as many as 10,000 are actually present.

As is known to those skilled in the art, the relative proportions of the various coal-tar components is quite different in tars made by low-temperature processes compared with those made by high-temperature processes, the former having a higher content of phenols and tar acids and a lower content of medium-soft pitch. High-temperature coal-tars are condensation products obtained by the cooling of gases which evolve in the high-temperature (>700° C.) carbonization of coal. High temperature coal-tars are of two main types: coke-oven tars and continuous vertical-retort (CVR) tars. Coke ovens for blast furnaces use the highest temperature (1250–1350° C.)., while a slightly lower temperature (1000–1100° C.) is applied in continuous vertical-retorts for the manufacture of domestic heating coke and gas.

The aromaticity of coal-tars increases and the content of paraffins and phenols decreases when the carbonization temperature increases. Thus, coke-oven tars contain relatively small amounts of aliphatic hydrocarbons, whereas CVR tars contain a higher proportion of straight-chain or slightly branched-chain paraffins (about 20% in the lower-boiling fractions of tar to 5–10% in the higher distillate oils). Coke-oven tars contain about 3% of phenolic compounds in the fractions distilling at up to 300° C. CVR tars, on the other hand, contain 20–30% of phenolic compounds. Both aromatic and heterocyclic rings occur in substituted and unsubstituted forms. The aromatic compounds in CVR tars are mostly alkyl derivatives, whereas coke-oven tars consist predominately of compounds containing unsubstituted rings.

The polynuclear aromatic hydrocarbon (PNA) profile of coal-tars is relatively independent of the starting material, being mainly a function of temperature. PNA concentrations found in high-temperature coal-tars may typically exceed 25%, with levels of benzo[a]pyrene often exceeding 0.5%. In coking experiments, it has been observed that the formation of benzo[a]pyrene starts at 700° C. and increases with temperature. At 1100° C., the benzo[a]pyrene content of the coal-tar is usually about 0.2%.

Low temperature coal-tars are the condensation products obtained by the cooling of gases which evolve in the low-temperature (<700° C.) carbonization of coal. They are black viscous liquids, more dense than water, and are less aromatic than high-temperature coal-tars. The content of aromatic hydrocarbons, usually alkyl-substituted, is only 40–50%. Low-temperature coal-tars also contain 30–35% of non-aromatic hydrocarbons and about 30% of alkali-extractable phenolic compounds in their distillate oils.

A wide variety of coal-tar-derived products exist, each serving a particular class of specialty applications. The distillate fractions, also known as tar oils, or creosote, are obtained by the fractional distillation of crude coal-tars. Creosotes are primarily used for timber preservation. Creosote is also used as an animal or bird repellent, animal dip, miticide, fungicide, herbicide and insecticide. Another product, anthracene oil is a semi-solid, greenish-brown crystalline material. Anthracene oil is obtained from the primary distillation of coal-tars in two fractions. The lower-boiling fraction (light anthracene oil) has a high content of phenanthrene, anthracene and carbazole; the higher-boiling fraction (heavy anthracene oil) has a high content of fluoranthene and pyrene. Benzo[a]pyrene concentrations range between 0.01 and 0.06% in anthracene oil.

Coal-tar pitch is a dark-brown-black, shiny, amorphous residue produced during the distillation of coal-tars. Pitch is composed of many different compounds which interact to form eutectic mixtures; consequently it does not show a distinct melting or crystallization point. Rather, it is characterized by its softening point. Depending on the depth of distillation, pitches with different softening points can be obtained. Pitch contains PNA's and their methyl and polymethyl derivatives, as well as heteronuclear compounds. When coal is carbonized to make coke and/or gas, crude coal-tar is one of the by-products. The low temperature processes are used to produce solid smokeless fuels for industrial and home heating.

As may readily be appreciated, the production of coal-tars is closely linked with steel production, because of the need for coke in steel making. Coal-tar is suitable for burning as a fuel in the steel industry in open-hearth furnaces and blast furnaces because of its availability, its low sulphur content and its high heating value. Both high-temperature and low-temperature coal-tars are used topically in the treatment of psoriasis and other chronic skin diseases. Coal-tar products are available in many pharmaceutical vehicles, including creams, ointments, pastes, lotions, bath and body oils, shampoos, soaps and gels. Shampoos are the most important of the products. The USP grade of coal-tar is used in denatured alcohol. Also, several surface-coating formulations contain coal-tar at varying concentrations.

The major use for coal-tar pitches is as a binder for aluminum smelting electrodes. Pitches are also used in roofing, surface coatings, for pitch coke production and for a variety of other applications. While bitumen is a more usual roofing material, coal-tar pitch is also used for this purpose. When used for roofing, the coal-tar pitch is heated and applied at approximately 200° C. Coal-tar pitch is also used in surface coatings. Black varnishes, which are soft pitches fluxed usually with heavy anthracene oil, are sometimes used as protective coatings for industrial steelwork and as an antifouling paint for marine applications. Pipe-coating enamels, made by fluxing a coke-oven pitch with anthracene oil, are used to protect buried oil, gas and water pipes from corrosion. About 75% of all underground petroleum, gas and municipal water pipelines are coated with coal-tar enamels. Coal-tar pitch is also used to impregnate and strengthen the walls of brick refractories, while target pitch, a very hard pitch, is used with a clay or limestone filler to produce brittle clay pigeons used for target practice.

Low-temperature pitch is also used as a road binder. Tar/bitumen blends, which may be polymer-modified, are used as surface-dressing binders. Coal-tar pitch is also used in the production of smokeless, precarbonized briquettes containing 8–10% of medium-soft coke-oven pitch.

Refined tar, which is made by fluxing a high-temperature pitch to a low softening-point with strained anthracene or heavy oils, is used as an extender for resins, including epoxy and polyurethane. Such formulations are used to produce abrasion-resistant, waterproof films, which are used for coating storage tanks, marine pilings and bridge decks. They are highly resistant to petroleum-based fuels. Soft coal-tar pitch is used to impregnate paper tubes to produce pitch-fiber pipes for the transport of sewage and effluents and for irrigation purposes.

As is readily evident, a wide variety of important applications exist for coal-tar-derived products. However, in recent years, concerns have arisen regarding the potential hazards associated with the use of various coal-tar-derived products containing polynuclear aromatics (PNA's), since certain of these compounds have been shown to cause cancer in humans and laboratory animals following exposure thereto, particularly those materials having high PNA levels.

To determine the relative mutagenic activity of a coal-tar-based product, a reliable test method for assaying such activity in complex hydrocarbon mixtures is required. A highly reproducible method showing strong correlation with the carcinogenic activity index of hydrocarbon mixtures is disclosed in U.S. Pat. No. 4,499,187, which is incorporated by reference in its entirety. From the testing of hydrocarbon samples as disclosed in U.S. Pat. No. 4,499,187, a property of the sample, known as its Mutagenicity Index (MI) is determined. Samples exhibiting MI's less than or equal to 1.0 are known to be non-carcinogenic, while samples exhibiting MI's equal to about 0.0 are known to be completely free of mutagenic activity.

U.S. Pat. No. 5,034,119 discloses a process for producing non-carcinogenic bright stock extracts and deasphalted oils from reduced hydrocarbon feedstocks. Such non-carcinogenic products are produced by establishing a functional relationship between mutagenicity index and a physical property correlative of hydrocarbon type for the bright stock extract or deasphalted oil and determining a critical physical property level which, when achieved, results in a product having a mutagenicity index of less than about 1.0. Process conditions are established so that a product stream achieving the desired physical property level can be produced. Non-carcinogenic bright stock extracts or deasphalted oils are then processed utilizing the conditions so established.

Despite these advances in the art, a need exists for a process for reducing the mutagenicity of coal-tar-based products.

SUMMARY OF THE INVENTION

In accordance with the present invention, a process for reducing the mutagenicity of a polynuclear aromatic containing coal-tar-derived material is provided. The process includes the step of contacting the polynuclear aromatic containing coal-tar-derived material having an initial mutagenicity index value in the presence of an alkylating agent with an acid catalyst under alkylation conditions sufficient to reduce the mutagenicity of the polynuclear aromatic containing coal-tar-derived material to a level less than the initial mutagenicity index value.

Also provided is a method for reducing the mutagenicity of a hydrocarbonaceous coal-tar process stream containing polynuclear aromatic compounds having three to seven rings. The method includes the step of contacting the polynuclear aromatic containing coal-tar process stream in the presence of an alkylating agent with an acid catalyst under alkylation conditions sufficient to reduce the mutagenicity of the alkylated polynuclear aromatic containing coal-tar process stream to a level less than the initial mutagenicity index value.

It is, therefore, an object of this invention to provide a process for reducing the relative mutagenicity of a polynuclear aromatic containing coal-tar-derived material.

It is a further object of this invention to provide a method for reducing the mutagenicity of a polynuclear aromatic containing coal-tar process stream which may be integrated with known downstream converting processes to produce coal-tar-based products of reduced mutagenic tendencies.

It is another object of this invention to provide a process for reducing the mutagenicity of a polynuclear aromatic containing coal-tar-based material which is cost effective.

Other objects, aspects and the several advantages of the present invention will become apparent to those skilled in the art upon a reading of the specification and the claims appended thereto.

DETAILED DESCRIPTION OF THE INVENTION

The present invention is predicated on the discovery that a mutagenically active coal-tar-based material containing polynuclear aromatic compounds can be made less mutagenic through alkylation. As is well known to those skilled in the art, alkylation is the addition or insertion of an alkyl group into a molecule. There are several types of alkylation reactions. Substitution by an alkyl group can result from attack on an aromatic hydrocarbon by a cation (carbocation), a neutral fragment (free radical), or an anion (carbanion). For each of the several types of alkylation reactions, a particular set of requirements exist, such as heat of reaction, rate of reaction, equilibrium conditions, free energy change, catalyst, equipment and the like.

In the practice of the present invention, the alkylation of coal-tar-derived materials and mixtures containing such materials can be carried out using olefins, alcohols, halides, ethers, or any olefin-producing reagent, although, for practical reasons, olefins are generally preferred. The interaction of an olefin with an aromatic hydrocarbon in the presence of a suitable acid catalyst is a preferred means of alkylation. This type of process is an example of electrophilic substitution. The attacking species is a carbocation, formed from the olefin by addition of a proton from a protonic acid, such as sulfuric acid, hydrogen fluoride or phosphoric acid, by a Friedel-Crafts type of catalyst, including aluminum chloride and boron fluoride, or by an oxide catalyst, such as a silica-alumina or zeolite catalyst.

The reaction may be represented as follows:

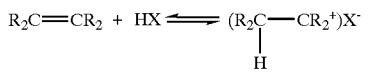

The X represents an anion, such as $SO_4H^-$, $AlCl_4^-$. The resulting carbocation, represented below as $R^+$, an electron-deficient species, adds to an electron-rich locale of the aromatic ring. The intermediate formed, splits off a proton to give the alkylated aromatic and a regenerated proton.

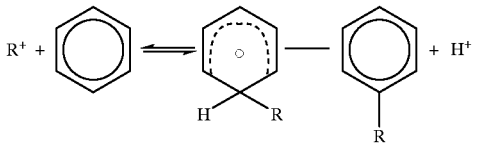

In selecting a suitable alkylation process for use in the practice of the present invention, the overall reaction can be considered as composed of two steps: The first step, formation of the carbocation from the olefin, is controlled by the nature of the specific olefin and the nature of the catalyst, including its activity. As is known to those skilled in the art, ethylene is the most difficult of the lower olefins to bring into reaction, with catalysts such as promoted aluminum chloride and elevated temperature used in such cases. Catalysts such as sulfuric acid and hydrogen fluoride are generally not suitable. The lower olefins containing a tertiary carbon atom, such as isobutylene, can readily be brought into the alkylation reaction, but as the molecular weight increases to octenes and higher, this readiness for alkylation diminishes, with side reactions often dominating. In the second step, the carbocation preferentially attacks those positions on the aromatic nucleus where electrons are most available. The presence of a substituent on the ring can alter this electron availability by two methods, involving an inductive mechanism and a conjugative mechanism. For this reason, the methyl group in toluene favors electrophilic substitution; a chlorine substituent makes substitution more difficult; a nitro group practically excludes substitution by an alkyl group.

As indicated above, catalysts suitable for use in the ring alkylation of aromatic hydrocarbons consist of three categories of acids: (a) protonic acids, (b) Friedel-Crafts catalysts, and (c) oxide catalysts.

Concerning the activity of protonic acid catalysts, it is known to decrease in the following order: $HF>H_2SO_4>H_3PO_4>C_2H_5SO_3H$. As may be appreciated, however, the choice of the catalyst depends not only on its activity, but on various other considerations. Commercially, phosphoric acid or its modification, silicophosphoric (solid phosphoric acid) is used commercially for the reaction of propene with benzene to form isopropylbenzene. Silicophosphoric acid is also known to catalyze the vapor-phase ethylation of benzene to form ethylbenzene, while reaction of higher alkenes with this catalyst is not recommended because of side reactions, such as skeletal isomerization, which accompany alkylation.

Sulfuric acid does not catalyze the ethylation of benzene, and it is not satisfactory for the reaction of propene with benzene to form isopropylbenzene. Sulfuric acid is, however, an effective catalyst for the alkylation of benzene with higher alkenes. Because of the sulfonating and oxidizing properties of sulfuric acid, alkylations in the presence of this catalyst are carried out at temperatures below 25° C. as compared with 60°–350° C. in the alkylation reactions catalyzed by silicophosphoric acid. Hydrogen fluoride is known to be an efficient catalyst for the alkylation of butenes and higher alkenes with benzene. The control of temperature is less critical than with sulfuric acid, and the catalyst is readily recoverable.

Concerning the activity of typical Friedel-Crafts catalysts, it is known to decrease in the following order: $AlBr_3>AlCl_3>GaBr_3>GaCl_3>FeCl_3$, $SbCl_5>ZrCl_4>BF_3>ZnCl_2>BiCl_3$. Completely anhydrous metal halides are known to be inactive as catalysts for the alkylation of aromatic hydrocarbons and require a co-catalyst. The addition of HCl or HBr, alkyl halide, or small amounts of alcohol or water activates the metal halides. The function of hydrogen halide is to react with the alkenes to produce alkyl halides, which, in the presence of the metal halides, can generate the activated alkyl complex.

The oxide catalysts envisioned for use in the practice of the present invention are heterogeneous catalysts which have a solid structure, such as the crystalline metallosilicate catalysts. Included among the crystalline materials are the zeolites and clays as well as amorphous silica/alumina materials which have acidic functionality. As is known to those skilled in the art, silica-alumina catalysts have been used for the alkylation of benzene with ethylene and propene. A number of crystalline aluminum silicates (zeolites) have been used for the alkylation of benzene and other aromatic hydrocarbons and hydrocarbon mixtures.

The porous crystalline materials known as zeolites are ordered, porous crystalline metallosilicates, usually aluminosilicates, which can best be described as rigid three-dimensional framework structures of silica and Periodic Table Group IIIA element oxides such as alumina in which the tetrahedra are cross-linked through sharing of oxygen atoms. Zeolites, both the synthetic and naturally occurring crystalline aluminosilicates have the general structural formula:

$$M_{2/n}O.Al_2O_3.ySiO_2.zH_2O$$

where m is a cation, n is its valence, y is the moles of silica and z is the moles of water. In the synthetic zeolites both aluminum and/or silicon can be replaced either entirely or partially by other metals, e.g. germanium, iron, chromium, gallium, and the like, using known cation exchange techniques. Representative examples of the contemplated synthetic crystalline silicate zeolites include the large pore Y-type zeolites such as USY, REY, and another large pore crystalline silicate known as zeolite Beta, which is most thoroughly described in U.S. Pat. No. 3,308,069 and Re. 28,341 which are herein incorporated by reference in their entireties. Other catalysts which are contemplated are characterized as the medium pore catalysts. There are other synthetic zeolites which have been synthesized which may be useful in the instant process. These zeolites can be characterized by their unique x-ray powder diffraction data. The following Table sets forth a mere few representative examples of zeolite catalysts which are believed suitable and reference to the corresponding patents which describe them:

TABLE A

| Zeolite | U.S. Pat. No. | Zeolite | U.S. Pat. No. |
|---|---|---|---|
| MCM-2 | 4,647,442 | ZSM-25 | 4,247,416 |
| MCM-14 | 4,619,818 | ZSM-34 | 4,086,186 |
| Y | 3,130,007 | ZSM-38 | 4,046,859 |
| ZSM-4 | 4,021,447 | ZSM-39 | 4,287,166 |
| ZSM-5 | 3,702,886 | ZSM-43 | 4,247,728 |

TABLE A-continued

| Zeolite | U.S. Pat. No. | Zeolite | U.S. Pat. No. |
|---|---|---|---|
| ZSM-11 | 3,709,979 | ZSM-45 | 4,495,303 |
| ZSM-12 | 3,832,449; 4,482,531 | ZSM-48 | 4,397,827 |
| ZSM-18 | 3,950,496 | ZSM-50 | 4,640,829 |
| ZSM-20 | 3,972,983 | ZSM-51 | 4,568,654 |
| ZSM-21 | 4,046,859 | ZSM-58 | 4,698,217 |
| Beta | 3,308,069; RE. 28,341 | | |
| X | 3,058,805 | | |
| Mordenite | 3,996,337 | | |

A particularly suitable zeolite catalyst used in the process of the invention is a porous crystalline metallosilicate designated as MCM-22. The catalyst is described in more complete detail in U.S. Pat. No. 4,954,325, the entire contents of which are incorporated by reference and reference should be made thereto for a description of the method of synthesizing the MCM-22 zeolite and the preferred method of its synthesis. Briefly; however, MCM-22 has a composition which has the following molar ranges:

$$X_2O_3:(n)YO_2$$

where X is a trivalent element, such as aluminum, boron, iron and/or gallium. Preferably X is aluminum. Y is a tetravalent element such as silicon and/or germanium preferably silicon and n is at least about 10, usually from about 10 to 150, more usually from about 10 to about 60, and even more usually from about 20 to about 40. In the as-synthesized form, zeolite MCM-22 in its anhydrous state and in terms of moles of oxides per n moles of $YO_2$, has the following formula $$(0.005–0.1)Na_2O:(1–4)R:X_2O_3:nYO_2$$

where R is an organic component. The Na and R components are associated with the zeolite as a result of their presence during crystallization, and are easily removed by known post-crystallization methods.

Representative examples of suitable naturally occurring zeolites include faujasite, mordenite, zeolites of the chabazite-type such as erionite, offretite, gmelinite and ferrierite.

Clay catalysts, another class of crystalline silicates, are hydrated aluminum silicates generalized by the following structural formula:

$$Al_2O_3SiO_2.xH_2O$$

Typical examples of suitable clays, which are acid-treated to increase their activity, are made from halloysites, kaolinites and bentonites composed of montmorillonite. These catalysts can be synthesized by known methods and are commercially available.

The catalysts suitable for use in this invention can be incorporated with a variety of known materials which are known to enhance the zeolite's resistance to temperature and reaction conditions of the conversion process of interest. These materials include other catalytically active materials such as other natural or synthetic crystalline silicates or inactive materials such as clays which are known to improve the crush strength of the catalyst or which act as binders for the catalyst. The catalyst can also be composited with a porous matrix. The porous matrix materials are well known in the art and are those which are advantageously used to facilitate extrusion of the catalyst.

The catalyst can be treated by steam stabilization techniques. These are known processes which are described in U.S. Pat. Nos. 4,663,492; 4,594,146; 4,522,929 and 4,429,176 the disclosures of which are incorporated herein by reference in their entireties.

The PNA-containing coal-tar-based feedstock is subjected to an alkylation reaction in the presence of an alkylating agent which, as indicated above, may be any olefin, alcohol, halide, ether, or any olefin-producing reagent. Included is any aliphatic hydrocarbon having at least one olefinic double bond capable of reacting with the PNA's of the feedstock. Suitable alkylating agents include long chain or short chain olefins. The term "long chain" olefin means that the olefin contains about 8 or more carbon atoms, more specifically 8 to 24 carbon atoms. The term "short chain" olefin is used to mean that the hydrocarbon contains less than 8 carbon atoms, more specifically less than about 5 carbon atoms. In general, the olefins contemplated herein contain at least one carbon-carbon double bond and can be a 1-olefin or a 2-olefin. The olefins can be straight chain or branched.

In the instant process, either short or long chain olefins may be preferred depending upon the final properties sought to be achieved by the alkylation product. For example, long chain olefins, that is, olefins having more than 8 carbon atoms are preferred in order to produce a product having a higher viscosity. Long chain olefin sources can be derived from light olefins ($C_2^=$ to $C_5^=$) via olefin dimerization and oligomerization reactions.

Olefinic hydrocarbon fractions can be used quite effectively as alkylating agents. Olefinic hydrocarbon fractions contemplated include olefin streams from the FCC unit, e.g., light olefins ($C_3$–$C_4$), and FCC gasoline fractions. Preferred olefinic feedstocks also include coker products such as coker naphtha, coker gas oil, distillate gasoline and kerosene.

Concerning the coal-tar-based feedstocks which can be benefitted by the present invention, as disclosed in U.S. Pat. No. 5,034,119, polynuclear aromatic compounds (PNA's) of 3–7 rings have been found to be responsible for the mutagenic activity of certain products and, as such, those materials having significant levels of such PNA's are among those feedstocks. The biologically active PNA's having 3–7 rings are generally considered to fall in the boiling range of 640 to 1000° F.

The Modified Ames Assay procedure disclosed in U.S. Pat. 4,499,187 is particularly preferred for use in determining the relative mutagenicity of a material as it can rapidly and reliably determine the potential carcinogenic activity of hydrocarbon mixtures of coal or petroleum origin. Mutagenicity index (MI), as disclosed in U.S. Pat. 4,499,187, is a ranking for relative mutagenic potency. MI is the slope of the dose response curve for mutagenesis. As indicated above, non-carcinogenic materials are known to exhibit MI's of less than or equal to about 1.0, with materials having no mutagenic activity at all exhibiting MI's equal to about 0.

The present invention is further illustrated by the following non-limiting examples.

EXAMPLE 1

This example demonstrates that the mutagenicity of benzo [a]pyrene (BaP) can be reduced by $C_4$ Friedel-Crafts alkylation.

Four 100 mg aliquots of BaP were placed in separate 20×150 mm screw-top tubes and dissolved in 5 ml carbon disulfide ($CS_2$). To each of these was added 1.0 ml of tert-butylchloride, which was thoroughly mixed. Ten to 15 mg of aluminum chloride ($AlCl_3$) were then added to each tube and mixed gently at room temperature while the reaction progressed. The reaction in the first tube was allowed to progress for one hour, the second tube for two hours, the third tube for three hours and the fourth tube for four hours. The samples were analyzed using a gas chromatograph (GC) and a flame ionization detector (FID). Table 1, below, presents the product distribution and mutagenicity index for the alkylation reaction products.

TABLE 1

PRODUCT DISTRIBUTION AND MUTAGENICITY INDEX VS. REACTION TIME

| Reaction Time. hr. | Mutagenicity Index. | % BaP | % Mono-$C_4$ BaP | % Di-$C_4$ BaP |
|---|---|---|---|---|
| 0 | 28.0 | 100 | — | — |
| 1 | 3.5 | 22 | 78 | 0 |
| 2 | N/A | >1 | 52 | 47 |
| 3 | 0.6 | 0 | 26 | 74 |
| 4 | 0.2 | 0 | 17 | 83 |

As may be seen, the mutagenicity index of a highly mutagenic compound, benzo[a] pyrene, can be substantially reduced through a $C_4$ Friedel-Crafts alkylation.

EXAMPLE 2

This example demonstrates that a $C_3$ Friedel-Crafts alkylation will also significantly reduce the mutagenicity of a furfural extract having characteristics similar to that of the material employed in Example 2. The furfural extract of this example also contained a significant level of mutagenic PNA's.

A 100 mg sample of the furfural extract was placed in a 20×150 mm screw-top tube and dissolved in 5 ml carbon disulfide ($CS_2$). To this was added 1.0 ml of isopropyl chloride, which was thoroughly mixed. Fifteen to 25 mg of aluminum chloride ($AlCl_3$) was then added and vigorously mixed. The tube was then agitated at room temperature for 23 hours while the reaction progressed. The sample was analyzed using a gas chromatograph (GC) and a flame ionization detector (FID) to assess the extent of the reaction. The mutagenicity index of the furfural extract before alkylation was 9.1, while the alkylated product had a mutagenicity index of 5.3.

Once again, the mutagenicity index of a significantly mutagenic PNA-containing sample was substantially reduced through Friedel-Crafts alkylation.

EXAMPLE 3

This example demonstrates the benefit in mutagenicity reduction achieved via $C_4$ Friedel-Crafts alkylation for a furfural extract of a certain lubricant refinery stream. The furfural extract contained a significant level of mutagenic PNA's.

A 100 mg sample of the furfural extract was placed in a 20×150 mm screw-top tubes and dissolved in 5 ml carbon disulfide ($CS_2$). To this was added 1.0 ml of tert-butylchloride, which was thoroughly mixed. Fifteen to 25 mg of aluminum chloride ($AlCl_3$) was then added. The tubes were agitated at room temperature for 6 hours while the reaction progressed. The sample was analyzed using a gas chromatograph (GC) and a flame ionization detector (FID) to assess the extent of the reaction. The mutagenicity index of the furfural extract before alkylation was 10.4, while the alkylated product had a mutagenicity index of <1.0

Again, the mutagenicity index of a significantly mutagenic sample, this time a furfural extract, was substantially reduced through $C_4$ Friedel-Crafts alkylation.

EXAMPLE 4

This example demonstrates the benefit in mutagenicity reduction achieved via $C_4$ Friedel-Crafts alkylation for a furfural extract of a certain propane deasphalted vacuum residuum, commonly referred to as bright stock extract (BSE). The BSE will usually contain a significant level of mutagenic PNA's.

A one-gram sample of the BSE was placed in a 20×150 mm screw-top tube and dissolved in 5 ml carbon disulfide ($CS_2$). To this was added 1.0 ml of tert-butylchloride, which was thoroughly mixed. Fifteen to 25 mg of aluminum chloride ($AlCl_3$) was then added. The tube was agitated at room temperature for 48 hours while the reaction progressed. The mutagenicity index of the BSE prior to alkylation was 1.7, while the alkylated product had a mutagenicity index of 0.2.

In this same experiment, one gram of the BSE was extracted with dimethylsulfoxide (DMSO) and the DMSO extract back-extracted with water and cyclohexane to isolate a PNA-enriched fraction of the BSE. A 50 mg aliquot of the extraction residue was alkylated under the same conditions as the BSE described above. The mutagenicity index of the BSE extract prior to alkylation was 32, while the alkylated product had a mutagenicity index of 0.2.

EXAMPLE 5

This example demonstrates that an alkylation reaction employing a silica supported $AlCl_2$ catalyst and an olefin significantly reduces the mutagenicity of BaP.

A 50 mg sample of BaP was placed in a 5 ml screw-top reaction vial and dissolved in 3 ml of carbon disulfide ($CS_2$). Approximately 260 mg of silica supported aluminum dichloride ($SiO_2$—$AlCl_2$) was added to the vial and the vial cooled in a dry ice-acetone bath to permit the addition of 45 microliters (2 mole equivalents) of 2-pentene. The reaction mixture was heated in an oil bath for 0.5 hours at 115° C. An additional 45 ul of 2-pentene was added after cooling and the reaction allowed to proceed for an additional 4 hours.

The sample was analyzed using a gas chromatograph (GC) and a flame ionization detector (FID) to assess the extent of the reaction. The GC/FID analysis indicated that approximately 98% of the starting BaP had been converted to a mixture of numerous mono-, di-, and tri-$C_5$ isomers of BaP. The mutagenicity index of the $C_5$-alkylated BaP reaction product was 0.4.

EXAMPLE 6

This example demonstrated that an alkylation reaction which employs an MCM-22 zeolite catalyst and an olefin, has the potential to alkylate BaP as per Examples 1 and 5 above and thus significantly reduce its mutagenic activity.

An MCM-22 catalyst was made in accordance with the process described in Example 11 of U.S. Pat. No. 4,954,325. Two 50 mg aliquots of BaP were placed in separate 5 ml screw-top reaction vessels and dissolved in 3 ml of carbon-disulfide ($CS_2$). Approximately 100 mg of MCM-22 catalyst was added to each of the vials and the vials cooled in a dry ice-acetone bath prior to the addition of approximately 10 mole equivalents of isobutylene. The reaction in one vial was allowed to proceed for 4 hours at 108° C. The reaction in the other vial was allowed to proceed for 0.5 hours at 175° C.

The samples were analyzed by GC/FID and the chromatograms compared to the chromatograms from Example 1. The product profile of the 108° C./4 hour reaction showed 74% conversion of BaP to the same mono- and di-$C_4$ alkylated products observed in Example 1 (see Table 1). The product profile of the 175° C./0.5 hour reaction showed 73% conversion of BaP to the same mono- and di-C4 alkylated products observed in Example 1 (see Table 1). Again, by comparison with Example 1 the reaction in Table 1 with 78% conversion to mono- and di-C4 alkylated BaP products has an MI-value of 3.5, significantly reduced from the BaP MI-value of 28.

EXAMPLE 7

This example demonstrates the benefit in mutagenicity reduction achieved via $C_4$ Friedel-Crafts alkylation for a coal tar extract derived from a medium crude coke oven tar. Such a material generally contains a significant level of mutagenic PNA's.

A one-gram sample of the coal tar extract, obtained from N.I.S.T as SRM 1597, was placed in a 20×150 mm screw-top tube and dissolved in 5 ml carbon disulfide ($CS_2$). To this was added 1.0 ml of tert-butylchloride, which was thoroughly mixed. Fifteen to 25 mg of aluminum chloride ($AlCl_3$) was then added. The tube was agitated at room temperature for 4 hours while the reaction progressed. GC/MS analysis of the reaction product indicated a predominance of di-alkylation products with mono- and tri-alkylated PNA derivatives also present at significant levels. The mutagenicity index of the coal tar extract prior to alkylation was 11, while the alkylated product had a mutagenicity index of 0.

Although the present invention has been described with preferred embodiments, it is to be understood that modifications and variations may be utilized without departing from the spirit and scope of this invention, as those skilled in the art will readily understand. Such modifications and variations are considered to be within the purview and scope of the appended claims.

What is claimed is:

1. A process for reducing the mutagenicity of a coal tar containing polynuclear aromatic compounds having three to seven fused aromatic rings, comprising the step of contacting the polynuclear aromatic containing coal tar having an initial mutagenicity index value greater than zero with an alkylating agent in the presence of an acid catalyst under alkylation conditions to introduce an branched chain alkyl group of three to five carbon atoms into the polynuclear aromatic compounds to reduce the mutagenicity of the polynuclear aromatic containing coal tar to a level less than the initial mutagenicity index value.

2. The process as described in claim 1, wherein the alkylating agent is selected from the group consisting of olefins, alcohols, halides, ethers and olefin producing reagents.

3. The process as described in claim 1, wherein the alkylating agent comprises a mixture of $C_3$–$C_4$ light olefins from an FCC unit.

4. The process as described in claim 1, wherein the alkylating agent comprises an olefinic FCC gasoline.

5. The process as described in claim 1, wherein the acid catalyst is selected form the group consisting of protonic acids, Friedel-Crafts catalysts, and oxide catalysts.

6. The process as described in claim 5, wherein the oxide catalyst is a crystalline metallosilicate catalyst.

7. The process as claimed in claim 6, wherein the crystalline metallosilicate catalyst is a natural or synthetic zeolite or an acid-treated clay catalyst.

8. The process as described in claim 7, wherein the acid-treated clay catalyst is an amorphous silica/alumina material having acidic functionality.

9. The process as described in claim 7, wherein the zeolite catalyst is zeolite Beta, USY or MCM-22.

* * * * *